US005622117A

United States Patent [19]

Burian et al.

[11] Patent Number: 5,622,117

[45] Date of Patent: Apr. 22, 1997

[54] HATCH COVER HAVING A REMOVABLE GASKET

[75] Inventors: William F. Burian, Downers Grove; Brian Walker, Naperville, both of Ill.

[73] Assignee: Salco Products, Inc., Romeoville, Ill.

[21] Appl. No.: 468,054

[22] Filed: Jun. 6, 1995

[51] Int. Cl.[6] ..... B65D 51/00

[52] U.S. Cl. ..... 105/377.07; 220/378; 105/377.08

[58] Field of Search ..... 105/377.07, 377.08, 105/377.05, 377.01, 358, 359, 360; 114/201 R, 203, 210 A; 220/358, 378; 277/178

[56] References Cited

U.S. PATENT DOCUMENTS

| | | | |
|---|---|---|---|
| 2,239,269 | 4/1941 | Lundvall | 105/377.07 |
| 2,663,268 | 12/1953 | Ahnell | 105/377.07 |
| 2,745,362 | 5/1956 | Lunde | 105/377.07 |
| 3,312,149 | 4/1967 | Fleckenstein et al. | 277/178 |
| 3,701,452 | 10/1972 | Tonn | 220/378 |
| 4,114,668 | 9/1978 | Hickey | 220/378 |
| 4,699,293 | 10/1987 | Duchrow | 220/378 |
| 4,738,905 | 4/1988 | Collins | 220/378 |

FOREIGN PATENT DOCUMENTS

| | | | |
|---|---|---|---|
| 278139 | 10/1927 | United Kingdom | 220/378 |

*Primary Examiner*—Mark T. Le

*Attorney, Agent, or Firm*—Dorn, McEachran, Jambor & Keating

[57] ABSTRACT

A hatch cover for railroad car hatch openings has a body member with inner and outer depending circular flanges. The flanges are located so as to span the loading nozzle or coaming of the hatch. The flanges and body portion define a three-sided pocket between them which receives a removable gasket. The gasket is retained in the pocket by a plurality of clips either integrally molded into the lower edges of the flanges or held by fasteners. The clips extend radially toward the opposite flange. The gasket is sufficiently resilient to allow a user to flex the gasket past the clips during installation and removal of the gasket in and out of the pocket. During opening and closing of the cover the clips retain the gasket in the pocket.

15 Claims, 3 Drawing Sheets

Fig. 1.
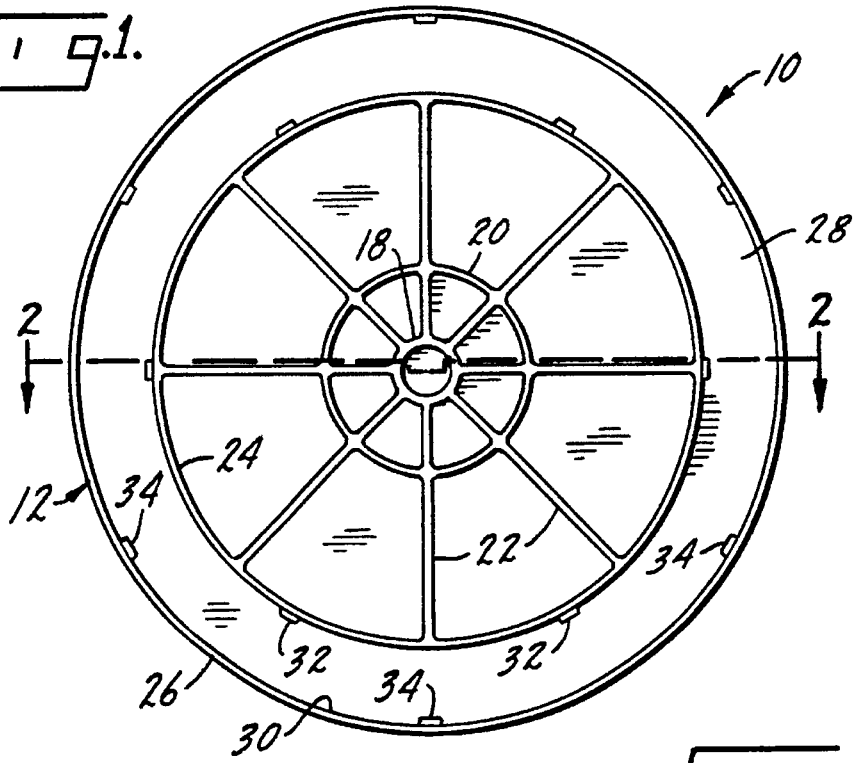
Fig. 2.
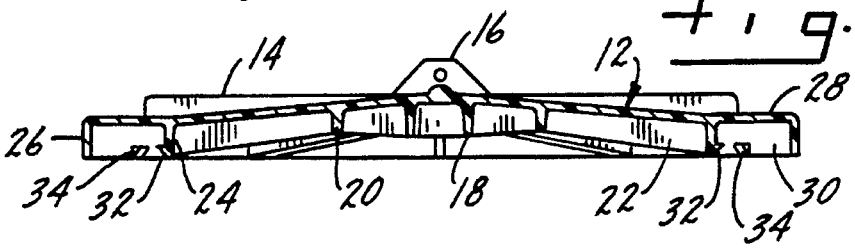
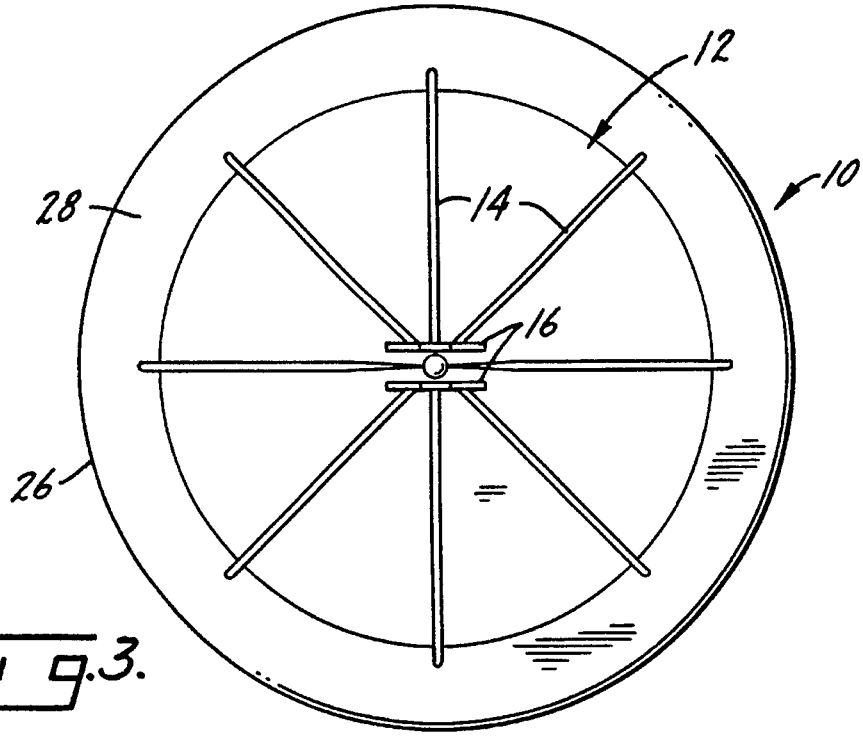
Fig. 3.

Fig. 4.
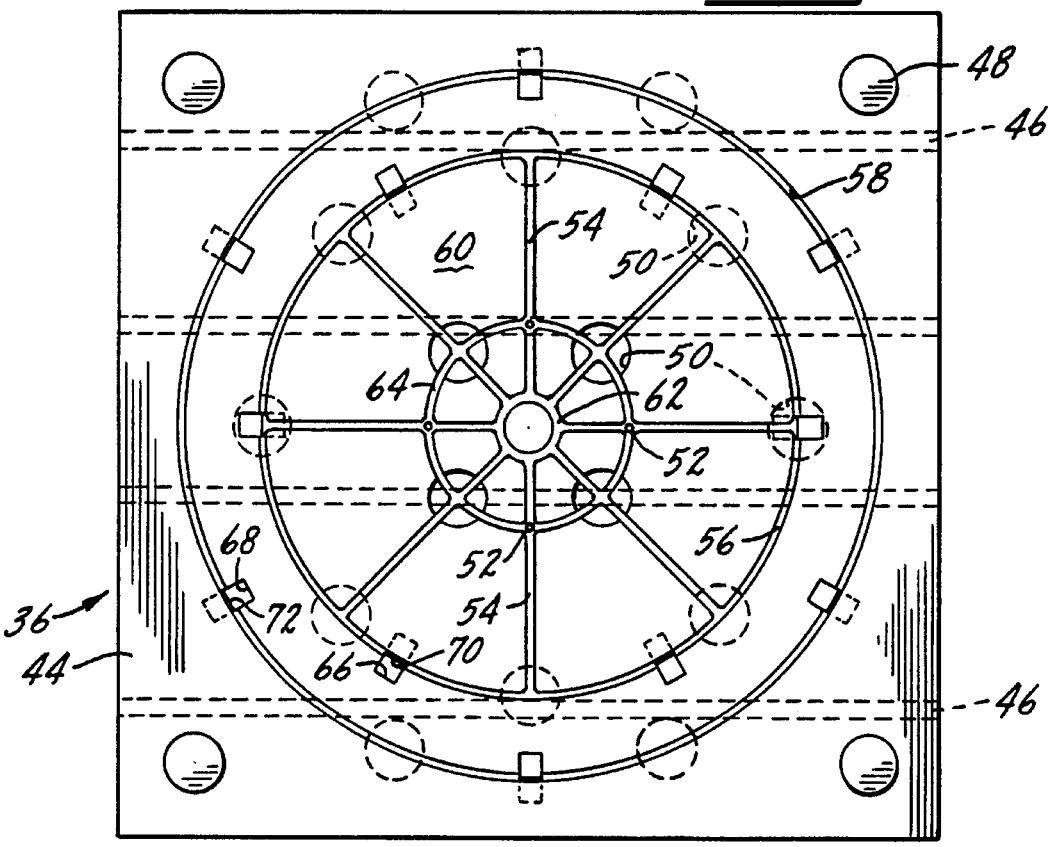
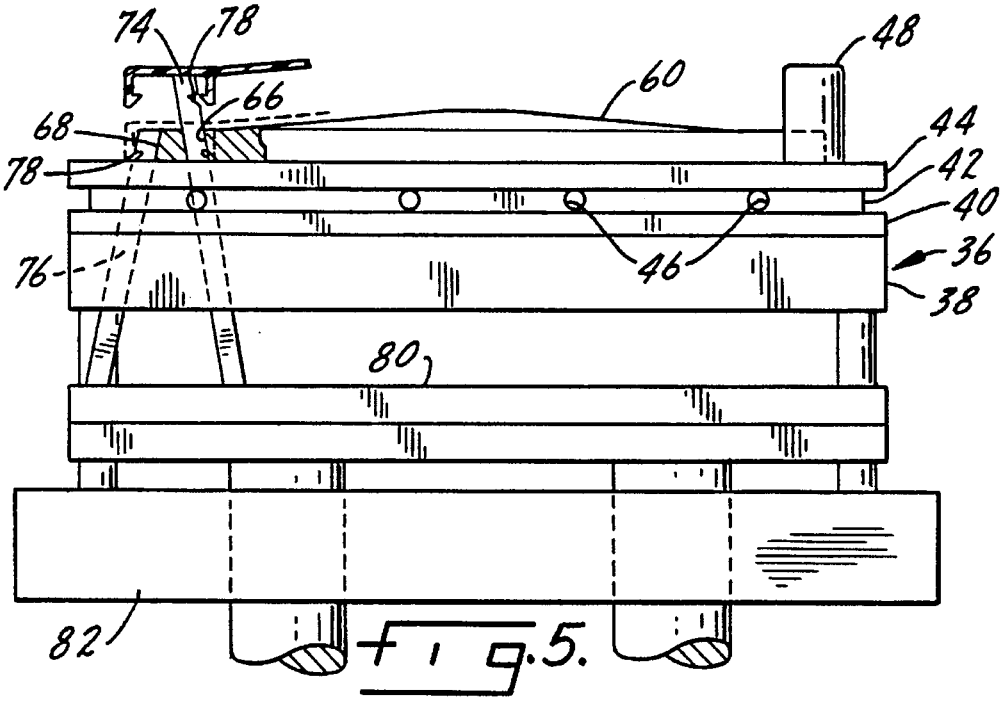
Fig. 5.

HATCH COVER HAVING A REMOVABLE GASKET

This invention concerns a hatch cover for railroad cars such as hopper cars. A hatch or manway provides access to the interior of the car for loading, venting and maintenance purposes. During transit the hatch opening is closed by a hatch cover. The cover is normally hinged and latched to the loading nozzle which is the upstanding tube surrounding the opening in the car body. The nozzle may be a plain cylindrical tube or it may have a rounded top edge known as a coaming. A gasket on the underside of the cover engages the nozzle or coaming to seal the opening.

Traditionally the gasket has been attached to the cover by an adhesive. This attachment method is so effective it becomes virtually impossible to remove the gasket. For certain types of service such as food grade service (e.g., transporting flour) it is necessary to be able to remove the gasket to clean it and the cover. Adhesively attached gaskets cannot meet this requirement. Obviously the gasket can be retained by bolts or other removable fasteners but these have the drawback of being relatively labor intensive. Furthermore, nuts and bolts have to be stocked at a maintenance shop, they have a tendency to get lost, fall into a open hatch, etc. In other words, they are a nuisance to the car operator. The present invention addresses the need to removably attach the gasket to the cover without the use of separable fasteners for the gasket.

SUMMARY OF THE INVENTION

The hatch cover of the present invention includes a body member having a gasket receiving pocket formed on its underside. Two sets of hooks cooperate with the body member to retain the gasket in the pocket without adhesive or fasteners. An outer set of hooks is located on a radius greater than that of the loading nozzle while an inner set of hooks resides on a radius less than that of the loading nozzle. Accordingly, the pocket is aligned with or overlies the top edge of the nozzle when the hatch cover is closed so a gasket in the pocket will engage the nozzle or its coaming. The hooks comprise a leg portion and a clip. The clip is integrally molded into the leg, with the inner clips directed toward the outer clips and the outer clips facing toward the inner clips. The clips have a length such that a gasket can be flexed around them for entry or exit from the pocket. During use the clips will engage the gasket to retain it in the pocket. In an embodiment used on a non-vented hatch cover the legs of the hooks comprise inner and outer flanges that extend continuously around the underside of the body member. In this case the clips are arcuately spaced about the flanges and preferably staggered between the inner and outer clips. In an embodiment used on a vented hatch cover the legs of the inner and outer hooks are not staggered but instead they are aligned and joined by a bail. The bail is secured to the pocket by a screw or the like.

Tooling for molding the clips in a non-vented hatch cover includes pivotable lifters having a notch therein for defining the mold cavity that forms a clip. Upon ejection of the cover from the mold the lifters pivot away from the clips allowing removal of the cover from the tooling.

BRIEF DESCRIPTION OF THE DRAWINGS

FIG. 1 is a bottom plan view of a non-vented hatch cover of the present invention.

FIG. 2 is a section taken along line 2—2 of FIG. 1.

FIG. 3 is a top plan view of the non-vented hatch over.

FIG. 4 is top plan view of a portion of the tooling for molding the non-vented hatch cover.

FIG. 5 is a side elevation view of the tooling of FIG. 4.

DETAILED DESCRIPTION OF THE INVENTION

Figure 6:
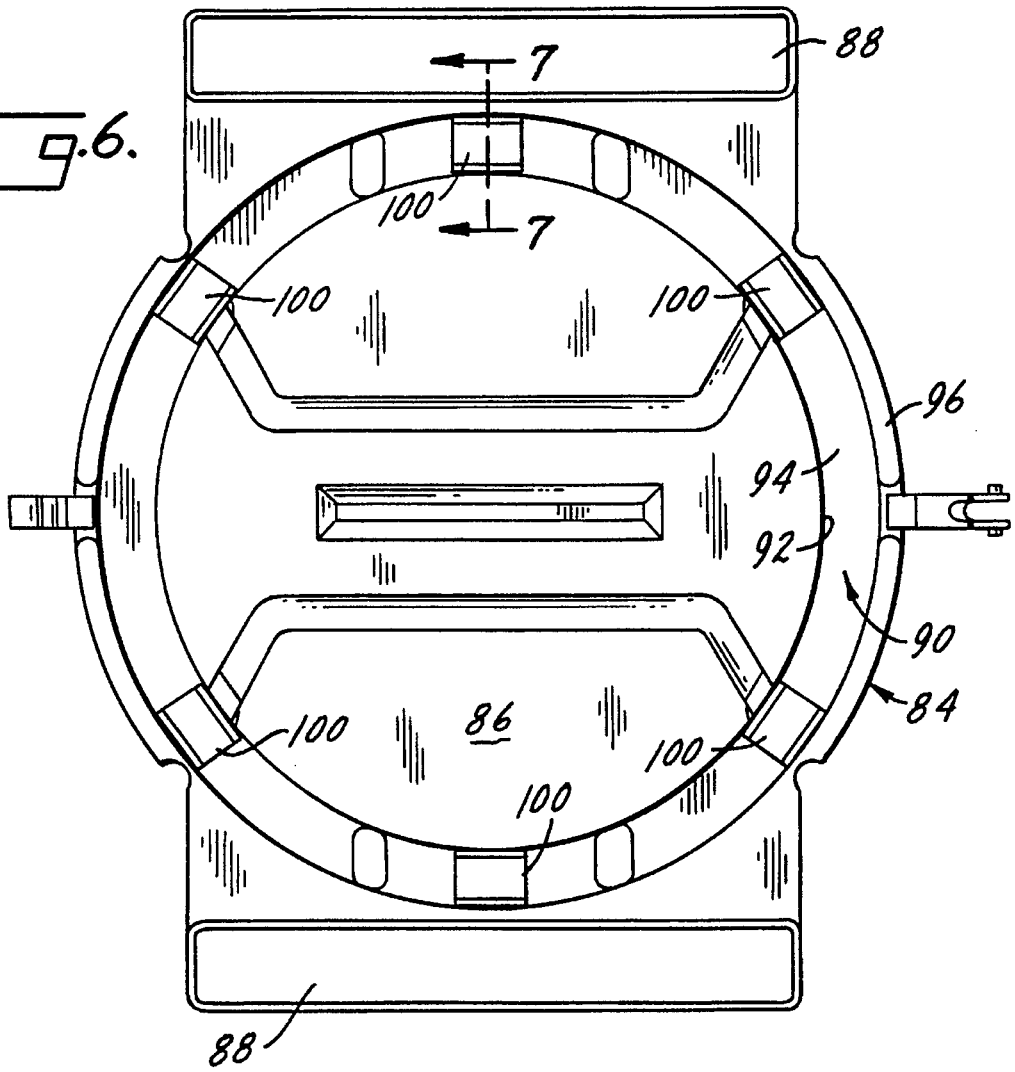
FIG. 6 is a bottom plan view of a vented hatch cover of the present invention.

FIGS. 1–3 illustrate a non-vented railroad car hatch cover of the present invention generally at 10. It has a shell or body member 12 having a size and shape which permits it to span or cover the hatch opening with a slight overhang all around. By far the most common shape for the hatch opening, and accordingly for the cover 10, is round but it could be otherwise. The use herein of terms such as radial, circular, arcuate and the like, while obviously referring to a round cover, do not limit the invention to a cover having that shape. Also, references to the top or bottom of the cover or the directions up or down refer to the cover when in its closed condition on a loading nozzle, i.e., when the cover is in a generally horizontal plane.

The body member 12 is a one-piece molded part, preferably made of ABS although other materials could be used such as PVC. The body member is slightly convex upwardly as seen in FIG. 2 so that its upper surface will not retain moisture. The top side of the body member has a plurality of radial ribs 14 formed therein to add rigidity to the body. There is also a bracket 16 on the top surface of the body for attachment of a latch arm. It will be understood that the latch arm is hinged to the upstanding nozzle of the hatch or otherwise connected to the car for retaining the latch arm and cover on the car.

The underside of the body member 12 has a central ring 18 and an intermediate ring 20 spaced outwardly from ring 18. A plurality of radial ribs 22 radiate from ring 18 past the intermediate ring 20. The rings 18 and 20 as well as the ribs 22 lend rigidity to the body member. The ribs terminate at an inner flange 24 which is fixed to the underside of the body member. Spaced outwardly of the inner flange 24 is an outer flange 26. It extends downwardly from the outer peripheral edge of the body member 12. The portion of the body member located between the inner and outer flanges defines a ring or disc 28. Together the disc 28, the inner flange 24 and the outer flange 26 define a gasket receiving pocket 30 between them. The pocket is three-sided with a downwardly-facing opening.

Each of the inner and outer flanges carries a plurality of arcuately-spaced clips. The clips are spaced from the body member 12 and are preferably located on the lowermost portion of the flanges. Clips 32 are integrally molded on the inner flange 24 while clips 34 are integrally molded on the outer flange 26. Clips 32 extend radially outwardly toward the outer flange while clips 34 face the other way, toward the inner flange. Thus, all the clips extend toward the center of the pocket 30. For reference purposes only, the clips on a twenty inch hatch cover may be a ¾" by ¼". In this embodiment each of the clips is on a different radius, i.e., they are arcuately staggered around the flanges, although aligned clips could also be used. The number of clips could be other than as shown, although six on each flange has been shown to be effective.

A portion of the tooling necessary to make the non-vented cover 10 as a one-piece, molded part is shown in FIGS. 4 and 5. The core side of the mold is shown generally at 36. It includes a B-plate 38 and three clamp plates 40, 42, 44. The center clamp plate 42 includes cooling water lines 46. Guide pins 48 for aligning the core half 36 with the cavity portion of the mold (not shown) are located at the corners of the plates. Knockout openings 50 receive knockout pins for removing a finished part from the mold. Four smaller knockout pins 52 are provided in the area of the intermediate ring 20. Channels 54 and groove 56 in the core section 60 provide for formation of the ribs 22 and inner flange 24. The exterior diameter 58 of the core cooperates with the cavity half (not shown) of the mold to form the outer flange 26. Similarly, grooves 62 and 64 form the central and intermediate rings 18 and 20. All of the grooves have a draft to permit release of the finished part. Preferably diameter 58 has a 1° draft while groove 56 has a 2° draft on both sides. Slightly higher drafts may be used on the rings. It will be understood that the draft angles could be other than those stated.

Rectangular passages 66 and 68 extend through the plates 38–44 and core section 60 at the sites of the clips 32, 34. The passages are disposed at an angle of 10° to a line normal to the plane of the plates. The walls of the groove 56 and diameter 58 are visible at 70 and 72 due to the draft angles.

Inner and outer lifters 74, 76 are shown in FIG. 5. The lifters 74, 76 are elongated, rectangular bars that slidably fit in and through the passages 66 and 68, respectively. For illustrative purposes in FIG. 5, the inner lifter 74 is shown in an extended, release position for removing a finished hatch cover while the outer lifter 76 is shown in a retracted position for molding. Obviously in actual use the lifters will both be either extended or retracted. The lifters each have a notch 78 that allows formation of the clips. When the lifter is in the retracted position the top surface of the lifter fills the passage so the lifter and core 60 together provide a continuous surface for molding the underside of the disc portion 28 of the body member. The portion of the lifter between notch 78 and the top surface adjoins one of the groove walls to assist in forming the wall of the flange facing the pocket.

All of the lifters are pivotally connected to a knockout box 80. The knockout box moves with the slide 82 of an injection molding machine. The core section 60 and clamp plates remain stationary. By virtue of the relative movement between the lifters and core section, and because of the 10° angle of the passages 66, 68 the notches 78 will have a radial component of motion that allows formation of the undercut clips 32, 34 and subsequent release of the part. With the 10° angle of the lifter passages about a 2.5 inch travel of the knockout box will create sufficient radial movement of the lifters to clear the clips for removal of a finished hatch cover.

It can be seen that the pocket 30 of the present invention is adapted to receive a flexible gasket. Preferably the gasket is a circular ring with a rectangular cross-section, although it could be otherwise. The gasket is installed by twisting it slightly in the vicinity of each clip 32, 34, working around the pocket from one clip to the next, to slip the gasket past the clips and into the pocket. Once installed the gasket returns to its normal flat configuration and as such it will be retained in the pocket by the clips. Removal of the gasket is accomplished by reversing the just described procedure.

Figure 7:
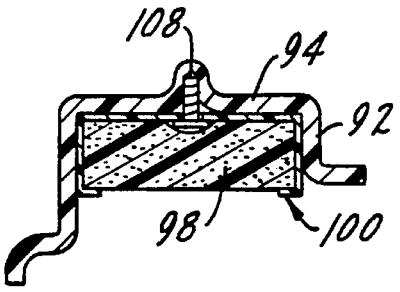
FIG. 7 is a section taken along line 7—7 of FIG. 1.
Figure 8:
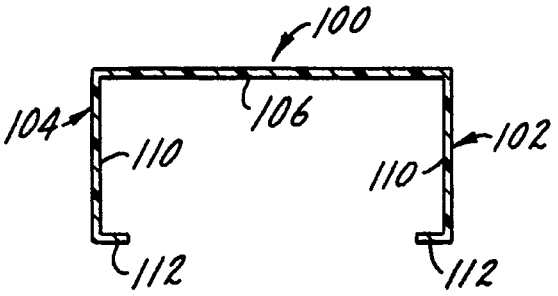
FIG. 8 is an enlarged end view of a retainer for a vented hatch cover.

FIGS. 6–8 illustrate the present invention as applied to a vented hatch cover shown generally at 84. The vented cover has a body member 86 and a pair of vents 88. The body member 86 includes a gasket receiving pocket 90 on its underside, defined by inner wall 92, seat 94 and outer wall 96. As is the case with the non-vented cover's pocket 30, the pocket 90 is three-sided with a downwardly facing opening. Further details of the vented hatch cover, as well as its application to a loading nozzle, are shown in U.S. Pat. No. 5,064,089, the disclosure of which is incorporated herein by reference. A gasket 98 (FIG. 7) is held in the pocket 90 by a plurality of retainers shown generally at 100. As best shown in FIG. 8, each retainer has an inner hook 102 and an outer hook 104. The two hooks are joined by a bail 106. The bail is fastened to the seat 94 by a screw 108 (FIG. 7). Alternatively, the retainer could be glued into the pocket. Each hook 102, 104 comprises a leg 110 and a clip 112. The clips 112 all face toward the center of the pocket. The gasket is installed in a fashion similar to that described for the non-vented cover. Thus, retainers 100 secure the gasket 98 in the pocket 90 without the use of adhesive or gasket fasteners. The screw used to attach the retainers need only be installed once upon manufacture of the cover. Thereafter gaskets can be installed and removed without the use of fasteners.

While a preferred form of the invention has been shown and described, it will be realized that alterations and modifications may be made thereto without departing from the scope of the following claims. For example, the clips in the non-vented cover need not be formed on continuous flanges. They could be attached to legs that are more or less no wider than the clips themselves. Thus, the legs and clips would define a hook similar to hooks 98, 100 of the vented hatch cover. If discrete hooks were used instead of clips formed on continuous flanges, some other arrangement for stiffening the outer portion of the non-vented cover may be required.

What we claim is:

1. A hatch cover for a railroad car hatch, comprising a body member having an underside and adapted to overlie an upstanding loading nozzle of a railroad car hatch, the body member defining a gasket receiving pocket which is aligned with the upstanding nozzle when the cover is closed upon the hatch, a first set of individual, spaced-apart hooks on the underside of the body member outwardly of the upstanding nozzle when the cover is closed on a hatch, a second set of individual, spaced-apart hooks on the underside of the body member inwardly of the upstanding nozzle when the cover is closed on a hatch, each of said hooks including a leg portion and a clip integrally formed on the leg, the clips being spaced from the body member and extending toward the center of the pocket a distance sufficient to enable the clips to retain an otherwise unsecured gasket in the pocket while also allowing the gasket to be flexed past the clips for installation in and removal from the pocket, the clips having a width which is small compared to the total extent of the pocket.

2. The hatch cover of claim 1 wherein the legs of the first set of hooks comprise a continuous flange extending around the periphery of the body member.

3. The hatch cover of claim 1 wherein the legs of the second set of hooks comprise a continuous flange extending around the body member inwardly spaced from the first set of hooks.

4. The hatch cover of claim 1 further comprising a plurality of ribs formed on the underside of the body member.

5. The hatch cover of claim 1 further comprising a plurality of ribs formed on the top side of the body member.

6. The hatch cover of claim 1 further comprising a reinforcing ring formed on the underside of the body member.

7. The hatch cover of claim 1 wherein the hatch cover is generally circular and each clip is centered on a different radius.

8. The hatch cover of claim 1 wherein the hatch cover is generally circular and the ribs on the underside of the body member extend radially from near the center of the body member to the second set of hooks.

9. The hatch cover of claim 1 wherein the inner and outer hooks are arranged in pairs on the same radius and each pair of hooks is joined by a bail which is fastened to the body member at the pocket.

10. A hatch cover comprising a body member, an outer flange attached to the body member and extending downwardly from a location at or near the perimeter of the body member, an inner flange attached to the body member and extending downwardly therefrom interiorly of the outer flange such that the body member, outer flange and inner flange define a three-sided, downwardly-open, gasket receiving pocket between them, and a plurality of individual, spaced-apart clips integrally molded on the inner and outer flanges, the clips being spaced from the body member and extending from one flange toward the opposite flange a distance sufficient to enable the clips to retain an otherwise unsecured gasket in the pocket while also allowing the gasket to be flexed past the clips for installation in and removal from the pocket the clips having a width which is small compared to the total extent of the pocket.

11. The hatch cover of claim 10 further comprising a plurality of ribs formed on the underside of the body member.

12. The hatch cover of claim 10 further comprising a plurality of ribs formed on the top side of the body member.

13. The hatch cover of claim 10 further comprising a reinforcing ring formed on the underside of the body member.

14. The hatch cover of claim 10 wherein the hatch cover is generally circular and each clip is centered on a different radius.

15. The hatch cover of claim 10 wherein the hatch cover is generally circular and the ribs on the underside of the body member extend radially from near the center of the body member to the inner flange.

* * * * *